US005224319A

United States Patent [19]

Nicholas

[11] Patent Number: 5,224,319

[45] Date of Patent: Jul. 6, 1993

[54] CENTERING BAR FOR ARCHITECTURAL JOINT SYSTEMS

[75] Inventor: John D. Nicholas, Lawrenceville, Ga.

[73] Assignee: Pawling Corporation, Pawling, N.Y.

[21] Appl. No.: 881,492

[22] Filed: May 11, 1992

[51] Int. Cl.[5] ..... E04B 1/68

[52] U.S. Cl. ..... 52/573; 52/396; 52/466

[58] Field of Search ..... 52/287, 468, 396, 573; 404/50, 62, 68

[56] References Cited

U.S. PATENT DOCUMENTS

| | | | |
|---|---|---|---|
| 3,183,626 | 5/1965 | Schmitt | 52/396 |
| 3,435,574 | 5/1969 | Hallock | 52/287 X |
| 3,659,390 | 5/1972 | Balzer | 52/396 X |
| 4,129,967 | 12/1978 | Barlow | 52/396 X |
| 4,566,242 | 1/1986 | Dunsworth | 52/573 |
| 4,967,527 | 11/1990 | Gohlke | 52/396 |
| 5,078,529 | 1/1992 | Moulton | 52/573 X |

FOREIGN PATENT DOCUMENTS 125283 4/1919 United Kingdom .

OTHER PUBLICATIONS

British Specification, 125283, Apr. 17, 1919, FIG. 1.

Article "Metalines Expansion & Seismic Joint Covers", pp. 4–8.

Article "C/S Group Expansion Joint Systems", pp. 14–15.

Article "MM Systems Corporation", pp. 6, 7, 12, 13.

*Primary Examiner*—Richard E. Chilcot, Jr.

*Assistant Examiner*—Beth A. Aubrey

*Attorney, Agent, or Firm*—Schweitzer Cornman & Gross

[57] ABSTRACT

A one-piece molded or cast centering bar, for an architectural joint system, is disclosed. The centering bar, which is designed for cooperation with spaced guide rails, mounted on opposed, relatively moveable structures, has a central base section and integral arm portions extending radially therefrom in opposite directions. Integral guide means are carried at the outer ends of the respective arm portions, and engage guide grooves in the respective guide rails. The centering bar is pivotally connected to a cover plate, which spans the space between the moveable structures. As the structures move toward and away from each other, the centering bar functions in a known manner to maintain the cover plate symmetrically positioned with respect to the open space.

5 Claims, 1 Drawing Sheet

CENTERING BAR FOR ARCHITECTURAL JOINT SYSTEMS

BACKGROUND AND SUMMARY OF THE INVENTION

Architectural joint systems commonly are installed to bridge over open space provided between two adjacent architectural structures which are expected to have relative movement, resulting from normal expansion and contraction, seismic activity or otherwise. One frequently employed type of architectural joint system incorporates a cover plate which extends over the open space and has side margins supported by the relatively movable structures on either side thereof. A centering mechanism is provided for maintaining the cover plate in centered relation to the open space, as the structures move toward and away from each other. Typically, such centering mechanisms involve the provision of guide rail means on each of the structures defining guide grooves or channels which extend along the adjacent edges of the structures. A plurality of centering bars are pivotally connected to the cover plate at various points along its length and are provided at their opposite ends with guide elements arranged to be received in the beforementioned guide grooves. Movement of the structures toward and away from each other causes the centering bars to pivot about their center points connected to the cover plate. This results in the center plate being held in a symmetrical, centered position relative to the movable structures.

Early designs of centering mechanisms of the type described above are shown in U.S. Pat. No. 3,183,623 and U.S. Pat. No. 4,566,242. Especially advantageous forms of such centering mechanisms are shown in my copending U.S. Pat. application Ser. No. 881,493, filed May 11, 1992. The present invention is directed particularly to a novel and advantageous form of centering bar element for utilization in such mechanisms.

In centering bar devices of known design, it is common to form the main body of the bar of a length of metal strip of the desired length, on the opposite ends of which are mounted guide elements of a suitable size and shape. For some installations, the guide elements may be spheres or semi-spheres, or perhaps cylinders, formed of plastic. The guide elements may also be formed of metal, depending on the load requirements. Conventionally, the guide elements are fastened to the flat metal bars by mounting pins or the like, which are fixed in the flat bar and extend upward into the guide element. In the case of the beforementioned U.S. Pat. No. 4,566,242, the metal bar is embedded into plastic guide elements. For attachment of the centering bar to the cover plate, the metal bar may be provided with a threaded center opening, for example, or a threaded sleeve or the like may be attached to the center of the bar.

In any of a number of its existing forms, the centering bar constitutes a relatively labor intensive, costly component, which inherently has significant weaknesses, especially in the attachment of guide elements to the outer ends of the main metal bar.

In accordance with the present invention, a novel and significantly improved centering bar device is provided, which is not only significantly less costly to manufacture, but is at the same time greatly improved in performance. Specifically, the centering bar is designed and constructed as a single, integral unit, advantageously molded of engineering plastic materials, or cast of metal. Importantly, the guide elements, mounted at the opposite ends of the centering bars, are integral portions of the bar as a whole, greatly increasing the strength of the unit at the critical outer end region. In the center of the unit, there is provided an integral base section, which extends at least in one direction. Usually downward, and preferably upward as well, from the radially extending arms which form the main body of the bar. Strengthening means, typically in the form of tapered webs or the like, extend from the base portion outwardly along the arm portions.

For a more complete understanding of the above and other features and advantages of the invention, reference should be made to the following detailed description of a preferred embodiment of the invention and the accompanying drawings.

DESCRIPTION OF A PREFERRED EMBODIMENT OF THE INVENTION

Figure 1:
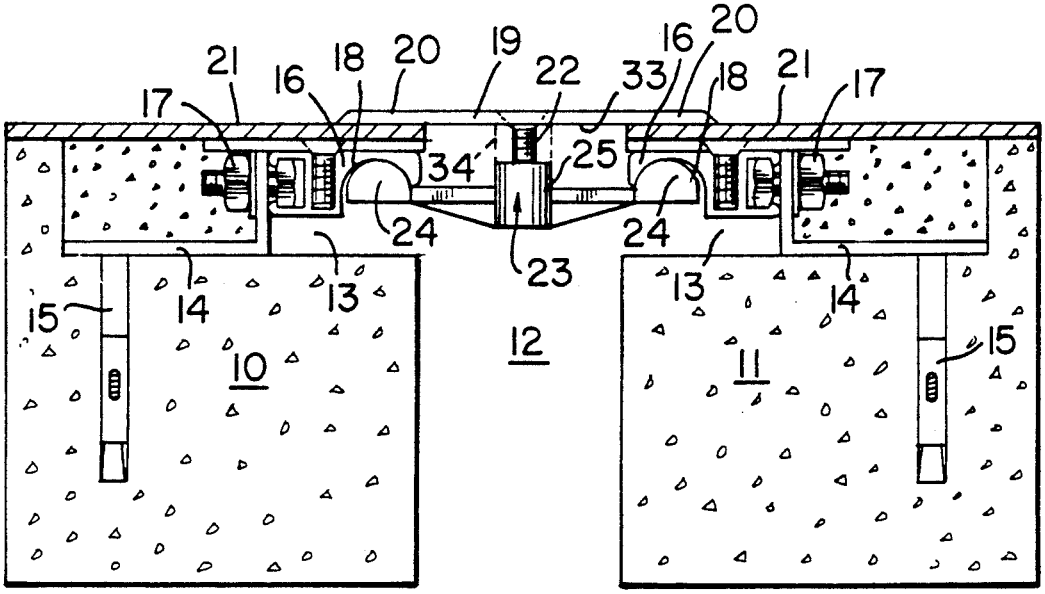
FIG. 1 is a fragmentary cross sectional view of an advantageous form of architectural joint system utilizing a cover plate centering mechanism and incorporating particularly the unitary centering bar device of the invention.
Figure 2:
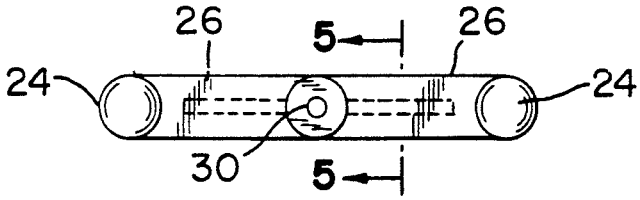
FIGS. 2, 3 and 4 are, respectively, top plan, side elevation and bottom plan views of the unitary centering bar device of the invention.
Figure 3:
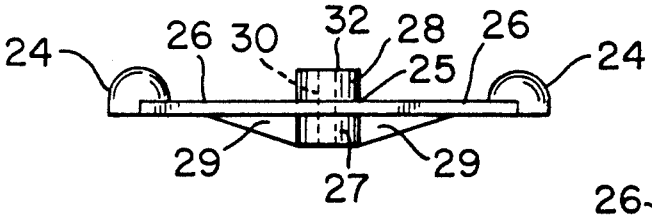
Figure 5:
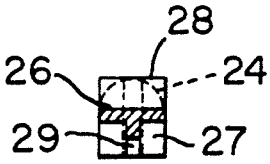
FIG. 5 is a cross sectional view as taken generally on line 5—5 of FIG. 2.
Figure 4:
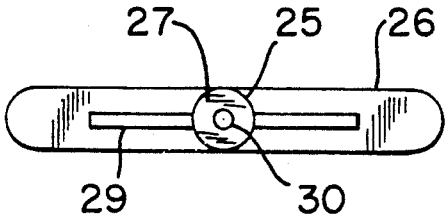

Referring now to the drawing, and initially to FIG. 1, reference numerals 10, 11 designate generally adjacent architectural structures, which are relatively movable with respect to each other and are separated by an intervening space 12. The structures 10, 11 may be of any type, including floors, walls, roof sections, etc. The particular form of architectural joint illustrated in FIG. 1 is representative of a floor joint, for example.

In the illustrated arrangement, each of the floor sections 10, 11 is formed with a block-out 13 mounting angle members 14 secured by anchor bolts 15. Guide rail elements 16 are anchored to the angle members 14, by means of bolts 17. The guide members 16, and techniques for mounting and utilizing the same form the subject matter of and are described and claimed in my beforementioned copending application. For the purposes of the present description, it is sufficient to note that the guide rail members are formed with continuous, downwardly opening semi-cylindrical guide grooves 18.

A cover plate 19 bridges the joint space 12 and has opposite side margins 20 overlying and supported by the opposed floor surfaces 21. In accordance with known general principles, the cover plate 19 is connected by screws 22 to a plurality of centering bars, generally designated by the reference numeral 23 and to be described in greater detail. The centering bars are of greater length than the maximum width of the space 12, so as to lie at an acute angle to the respective guide grooves 18. The centering bar includes guide means 24 at each end slidably engaged in the guide grooves 18. Accordingly, as the floor structures 10, 11 move toward and away from each other, the centering bars 23 are caused to pivot about the mounting screws 22, causing the cover plate to be maintained in a centered or symmetrical position relative to the floor sections 10, 11 during movement thereof.

In accordance with the present invention, the centering bar 23 is of a unitary, integral construction throughout. For certain, relatively low stress applications, the centering bar advantageously is formed of injection molded engineering plastics. For applications requiring greater strength, the part may be a unitary casting of appropriate metal.

Pursuant to the invention, the centering arm 23 includes a central base section 25, typically of cylindrical configuration. Arm portions 26, integral with the base section 25, extend radially outward in opposite directions for a predetermined distance calculated to be somewhat greater than the space 12 in the system in which it is to be employed. At least one portion 27 of the base section 25 projects vertically (preferably downward) from the arm portions 26, and advantageously a second portion 28 projects vertically in the opposite direction from the arm portions. Stiffening elements 29 of outwardly narrowing tapered configuration extend from the lower projection 27 of the base section radially outward along the arm portions 26 to impart stiffness against vertical flexing. In appropriate cases, stiffening elements 29 may be provided, either alternatively or in addition along the top of the arm portions 26.

At the outer ends of the arm portions 26, there are provided guide elements 24 of generally semi-spherical configuration. These elements are integrally joined to the outer end extremities of the arm portions 26. Particularly where the guide elements 24 are of semi-spherical configuration, the entire base area, i.e., the full diameter of the spherical form, can be joined with the arm portions 26. To this end, it is advantageous that the arm portions have a width equal to or greater than the diameter of the guide elements 24.

As shown in the drawings, the central base portion 25 has a vertical height greater than the thickness of the arm portions 26. A vertical bore 30 extends through the center of the base portion 25 and is adapted for reception of the mounting screw 22. To advantage, the vertical bore 30 is not tapped, but is smooth walled, in which case the mounting screw 22 is of a self-tapping type.

For installation of the cover plate and centering bars 23, the centering bars can be loosely attached to the cover plate by screws 22, and oriented generally lengthwise of the open space 12. After the cover plate is laid over the space 12, the screws 22 are tightened. Initially, the centering bars 23 will tend to rotate, but will be limited in rotation by outer walls 31 of the guide grooves 18. When the screws 22 are properly tightened, a slight downward force may be exerted on the cover plate 19, and a corresponding upward force on the arm portions 26 of the centering bar. The stresses of the upward force on the centering bar are effectively resisted by the stiffening elements 29.

In some cases, it may be desirable to specifically limit the vertical stresses on the centering bar 23 and/or cover plate 19. In such a case, the vertical height of the upward projection 28 of the central base section is precalculated, so that the upper surface 32 of the base section contacts the bottom surface 33 of the cover plate, when the centering bar is in its normal, operative position, thus limiting the vertical stresses that can be applied to the centering bar 23 and to the cover plate 19. A vertically extended central base section 25 is indicated by broken lines 34 in FIG. 1. Since the distance between the bottom surface of the cover plate and the guide grooves 18 is known in advance from the design of the architectural joint system, the vertical height of the central base section 25 can easily be pre-calculated to come into contact with the bottom surface of the cover plate before overstressing of the parts is realized.

The unitary centering bar device of the invention, although simplified in nature, represents an improvement of major significance compared to the existing devices. The production costs of the device of the invention are in the order of one half the cost of conventional devices. At the same time, the device of the invention provides significantly superior performance characteristics, especially in the strength of the device where the guide elements join with the radially extending arm portions. Whereas conventional devices are labor intensive, the device of the present invention may be replicated by largely automatic molding or casting procedures, with assurance that dimensions and tolerances will have a high degree of uniformity.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention. By way of example, in the above description and in the following claims, directional and orientational references, such as top, bottom, upward, downward, etc. are employed for convenience of description only as the elements of the structure perform identically whether oriented horizontally, vertically or otherwise, and whether used in the orientations illustrated in the drawings or in reversed or upside down orientations.

I claim:

1. For use in an architectural joint system for bridging a space between adjacent relatively movable structures and of the type having guide rail means mounted on each of said structures and provided with open-sided, generally downwardly opening guide grooves, a cover plate of greater width than said space bridging said space and being supported at each side of said space by said movable structures, and centering bar means pivotally connected to said cover plate and having guide means at each end slidably engageable in and guided by said guide grooves, the improvement in said centering bar which comprises (a) said centering bar being of one-piece, molded or cast construction throughout, (b) said centering bar including a base section at the center and integral arm portions extending radially from said base section in opposite directions, (c) said base section having portions extending vertically said arm portions, (d) guide elements of generally semi-spherical configuration carried integrally at outer ends of said arm portions and projecting upward therefrom, (e) said arm portions having a width dimension not substantially less than the diameter of said semi-spherical guide elements, (f) a vertical central bore in said base section extending downward from an upper end of said base section for the reception of a fastening element extending from said cover plate, (g) stiffening elements extending radially outward from vertically extending portions of said base section and joined integrally with said arm sections.

2. An improved centering bar according to claim further characterized by, (a) said base section having a portion extending upwardly above said arm portions and substantially into contacting relation to said cover plate.

3. An improved centering bar according to claim 1, further characterized by, (a) said central bore being a smooth-walled bore, and (b) self-tapping fastening means being provided for connecting said cover plate to said base section.

4. An improved centering bar according to claim 2, further characterized by (a) said base section having a portion extending downwardly below said arm portions, and (b) said stiffening elements extending radially from said downwardly extending portion.

5. For use in an architectural joint system for bridging a space between adjacent relatively movable structures and of the type having guide rail means mounted on each of said structures and provided with open-sided, generally downwardly opening guide grooves, a cover plate of greater width than said space bridging said space and being supported at each side of said space by said movable structures, and centering bar means pivotally connected to said cover plate and having guide means at each end slidably engageable in and guided by said guide grooves, the improvement in said centering bar which comprises (a) said centering bar being of one-piece, molded or cast construction throughout, (b) said centering bar including a base section at the center and integral arm portions extending radially from said base section in opposite directions, (c) integral guide means at outer ends of said arm portions and extending upward therefrom for reception in said guide grooves, and (d) a vertical central bore in said base section extending downward from and upper end of said base section for the reception of a fastening element extending from said cover plate.

* * * * *